United States Patent [19]

Escallon

[11] Patent Number: 4,795,339

[45] **Date of Patent: * Jan. 3, 1989**

[54] METHOD AND APPARATUS FOR DEPOSITING NONCONDUCTIVE MATERIAL ONTO CONDUCTIVE FILAMENTS

[75] Inventor: Eduardo C. Escallon, Elwood, Ind.

[73] Assignee: Terronics Development Corp., Elwood, Ind.

[ * ] Notice: The portion of the term of this patent subsequent to Apr. 15, 2003 has been disclaimed.

[21] Appl. No.: 852,352

[22] Filed: Apr. 15, 1986

Related U.S. Application Data

[63] Continuation-in-part of Ser. No. 773,777, Sep. 9, 1985, Pat. No. 4,582,718.

[51] Int. Cl.[4] ..... B05D 1/06

[52] U.S. Cl. ..... 427/32; 427/117; 427/120; 118/627; 118/629; 118/634

[58] Field of Search ..... 427/27, 32, 117, 120; 118/627, 629, 634

[56] References Cited

U.S. PATENT DOCUMENTS

| | | | |
|---|---|---|---|
| 2,777,784 | 1/1957 | Miller | 427/32 |
| 3,248,253 | 4/1966 | Barford | 427/32 |
| 3,436,442 | 4/1969 | Saks | 427/32 |
| 4,188,413 | 2/1980 | Lupinski | 427/32 |
| 4,221,185 | 9/1980 | Scholes | 118/638 |

FOREIGN PATENT DOCUMENTS

| | | | |
|---|---|---|---|
| 1125026 | 3/1962 | Fed. Rep. of Germany | 427/32 |
| 754478 | 8/1956 | United Kingdom . | |

*Primary Examiner*—Richard Bueker
*Attorney, Agent, or Firm*—Lundy and Walker

[57] ABSTRACT

An electrostatic filament coater comprising a plurality of coating chambers arranged coaxially in spaced apart serial relation. Each of the coating chambers has a base and an apex and being generally frusto-conical in shape with an exit opening at the apex and an entrance opening at the base. All of the coating chambers except the last one are positioned with the apex being within the base of the next adjacent coating chamber. The filament is trained through the coating chambers. A plurality of electrodes are positioned within the coating chambers so as to surround the filament. A near arc-over voltage is supplied to the electrodes and a fog of particulate coating material suspended in a gas is passed through the coating chambers and axially of the filament at a velocity which results in the electrostatic deposition of the particulate matter on the filament and the exhaust of the gas and excess particulate matter from between the coating chambers and the apex opening of the last coating chamber. The method of the invention includes the steps of passing a filament through a cloud of particulate coating material suspended in a gas, surrounding the filament with a plurality of spaced apart electrodes, imposing a near arc-over potential to the electrodes and imposing a near arc-over potential to the electrodes to electrostatically deposit the particulate coating material on the filament.

19 Claims, 3 Drawing Sheets

METHOD AND APPARATUS FOR DEPOSITING NONCONDUCTIVE MATERIAL ONTO CONDUCTIVE FILAMENTS

RELATED APPLICATION

This is a continuation in part application of U.S. patent application Ser. No. 773,777 entitled "METHOD AND APPARATUS FOR DEPOSITING NONCONDUCTIVE MATERIAL ONTO CONDUCTIVE FILAMENTS" filed on Sept. 9, 1985 now U.S. Pat. No. 4,582,718.

BACKGROUND OF THE INVENTION

The present invention relates generally to the field of electrostatic deposition of fine non-conductive particles onto a conductive substrate, and more particularly to such deposition onto a moving elongate filament on a high speed continuous basis.

Typically, filaments such as wires are coated with solvent borne organic materials for decorative or functional purposes. Apparatus for this application are described in the literature, a typical arrangement being described in U.S. Pat. No. 4,022,933. The use of solvents in these coating systems poses two difficulties. One is the organic emissions which have to be incinerated or catalytically oxidized to comply with emissions standards. The other is the cost of the solvents lost during the process.

The above referenced patent describes a system for coating wire using high solids chemistry in which the percent of solvent usage is reduced by perhaps as much as one half over prior technology. However, such high solids coatings tend to have rheology problems during application due to their highly viscous state. Preheating of the coating material is generally required prior to application. Even so, the high viscosity can result in bare spots or misses in coverage of the substrate, and in another defect known as candle waxing or roping which is a longitudinally occurring radial variation in coating thickness.

Some coated filaments require relatively thin coatings superimposed on the filament which are not only continuous (no bare sports or pin holes) but concentric. Magnet wire is such a coated filament. See ANSI/-NEMA MW 1000 1981.

An alternative approach to coating wire using powder chemistries offers benefits in many areas. Powder coating involves virtually no solvent, so emission standards can be met without expensive after burners. Additionally, powder coatings can be formulated with higher molecular weights than liquid coatings which helps to produce tougher coatings, with generally greater resistance t environmental deterioration. Furthermore, if electrostatic application of the powder is used, bare spots and local irregularities, such as the candle waxing, can be minimized. U.S. Pat. No. 3,019,126 details both an electrostatic and non-electrostatic means for coating wire, with a fluidized bed as the central element.

SUMMARY OF THE INVENTION

A general summary of the nature of the present invention as well as some of its objects, advantages and uses is set forth briefly below. It should be understood, however, that this summary is not a comprehensive definition of the scope of the invention and is not intended as a limitation thereof.

The basic principle behind the present invention is the proposition, known in the art, that a conductive filament can be coated by passing it through a dispersion of fine particles in the presence of an electrostatic field, thereby causing the particles to become charged and drawn t the conductive filament where they adhere. The conductive filament with adhered particles can then be heated to fuse the particles into a smooth and continuous coating.

One aspect of the present invention contemplates coating the conductive filament in a vertical orientation; hence, no compensations have to be made for gravitational effects during either the application of the powder, or the melt to liquid phase occurring in the early portions of the curing operation.

Another aspect of the invention involves a plurality of hollow cones stacked vertically in spaced relationship, with each of the cones converging inwardly from bottom to top. The wire passes vertically up through the cones which are fitted on their interior surfaces wth high potential corona generating electrodes. Powder is injected upwardly into the chamber formed within tee cones. As the powder rises through the chamber, it is directed radially inwardly toward the filament under the combined influence of the electric field impressed between the electrodes and the filament and an inward velocity vector caused by the convergence of the boundary of the chamber as defined by the interior surfaces of the cones. The upward flow of powder causes an inward flow of air to be drawn through the spaces between the cones, thereby contributing toward the radially inward acceleration of the powder. Overspray or undeposited power tends to exit between the cones and accumulate on the exterior surfaces thereof where it is periodically shed without danger of being deposited on the filament.

Yet another aspect of the present invention involes particle size reduction of the powder prior to injection into the coating chamber. The powder, carried by a jet of air, is passed through a converging-diverging nozzle which shears agglomerated particles into smaller sized particles just prior to their entry into the deposition zone. Consequently, much thinner coatings are typically achieved. Typical powder coatings are applied in thickness of 0.8 mil and up. The present invention is capable of applying coatings as thin as 0.2 mils. Another aspect which contributes to particle size reduction is the use of vibrating troughs for delivering the bulk powder to the nozzle.

One object of the present invention is to apply, by means of electrostatics, a selected thickness of fine, non-conductive particles or short fibers onto a moving conductive filament or a plurality of filaments in a very uniform manner, at high speed, and with high deposition efficiency, to form a continuous uniform, concentric coating superimposed on the filament.

Other objects and advantages of the present invention will become apparent from the following descriptions and drawings, and from the claims appended below.

DESCRIPTION OF THE PREFERRED EMBODIMENT

Figure 1:
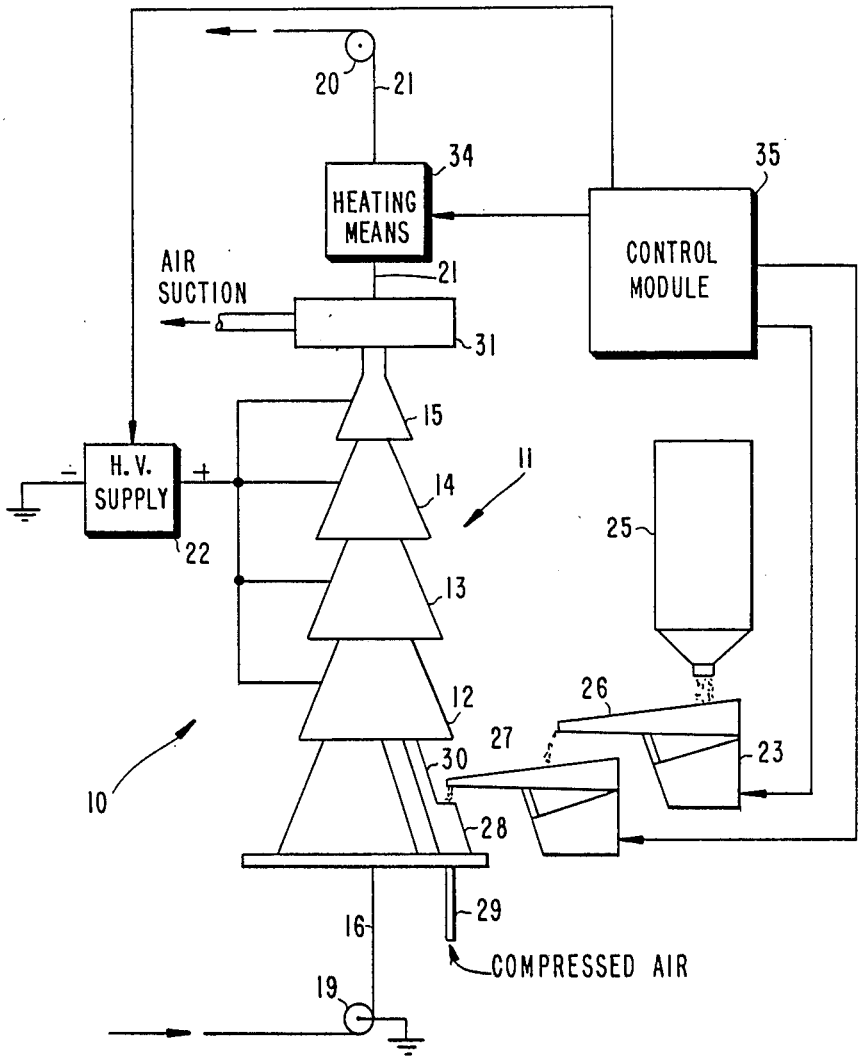
FIG. 1 is a schematic drawing showing an electrostatic filament coater in accordance with the present invention.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Referring in particular to FIG. 1, there is illustrated the scheme of an electrostatic wire coater 10 comprising the preferred embodiment of the present invention. The principal component of wire coater 10 is coating column 11 including cones 12, 13, 14 and 15, which will be described in greater detail below. Passing upwardly through coating column 11 is filament 16 which is an electrically conductive wire or other elongate filament which is to be coated by wire coater 10. Inasmuch as one of the objects of the present invention is to coat filament 16 on a continuous basis, filament 16 is shown supported below and above coating column 11 by pulleys 19 and 20, it being understood that uncoated filament 16 is transported to pulley 19 from a spool or other source not shown, and that coated filament 21 emerging from the top of wire coater 10 passes over pulley 20 and is then collected on another spool or otherwise treated as desired. Not shown but inherent to the scheme of wire coater 10 is a means for driving and tensioning filament 16 and controling its speed. Filament 16 is electrically grounded at pulley 19.

Figure 3:
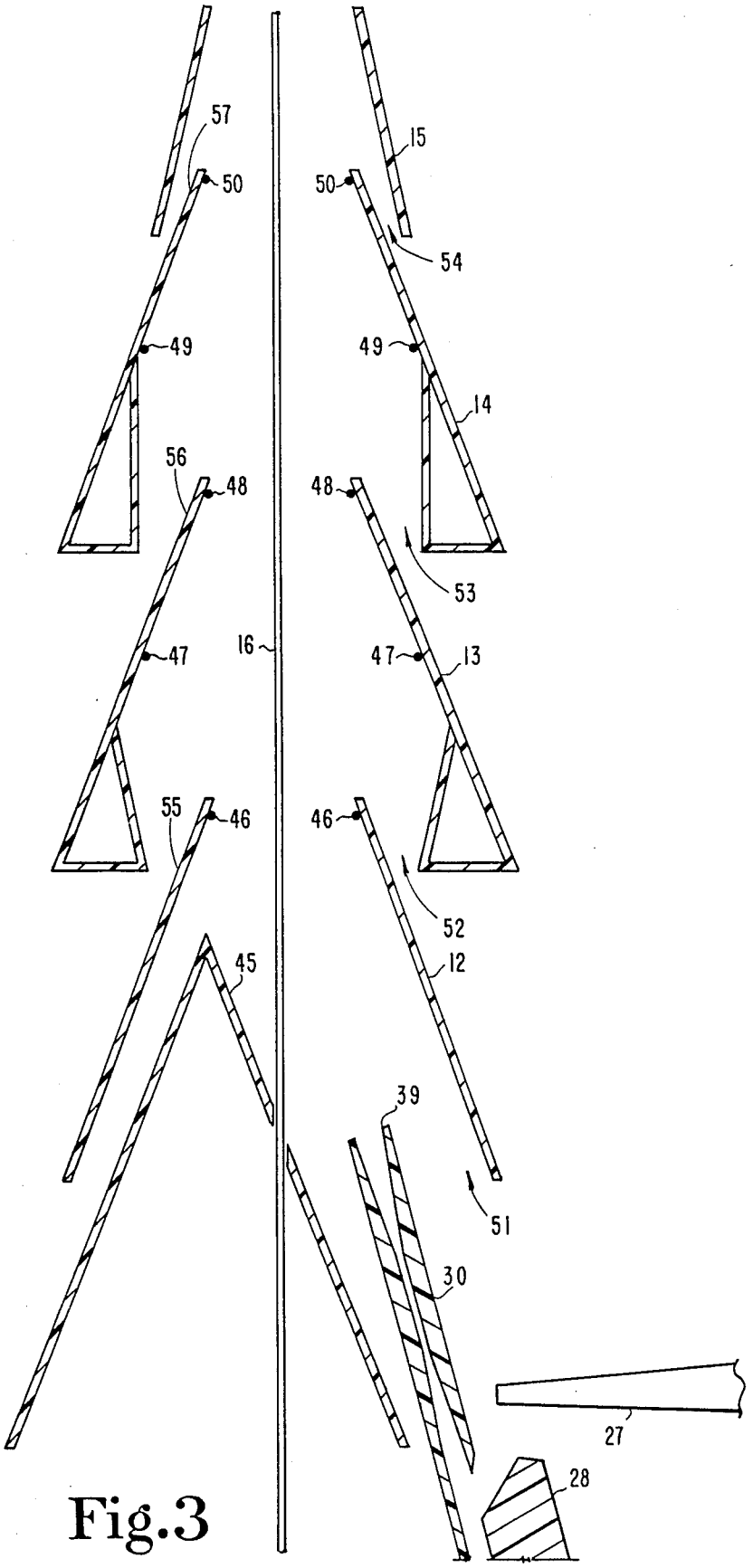
FIG. 3 is a cross-sectional elevational view of the coating column of the filament coater of FIG. 1.

Another element of wire coater 10 is high voltage supply 22 which is connected to fine wire hoop electrodes 46–50 located circumferentially within each of cones 12–15, and shown in FIG. 3. High voltage DC supply 22 impresses high voltage on the electrodes of column 11 causing a strong electrostatic field to exist between the electrodes and grounded filament 16.

The particulate material which is to be coated onto filament 16 is delivered from reservoir 25 at a controlled rate into vibrating trough 26. Trough 26 is made to vibrate by a reciprocating electric solenoid 23 attached thereto. Solenoid 23 is activated by an rectification of a sinusoidal signal by means of a silicon controlled rectifier, with the triggering level being adjustable to control the amplitude of the vibration. Such a wave form is characterized by a fast rising leading edge and a sinusoidally falling trailing edge. The resulting vibration breaks up clumps of agglomerated particles and causes particles to migrate along trough 26 toward the open end where they fall into a second vibrating trough 27. Vibrating trough 27, similar in structure and operation to trough 26, further breaks up agglomerations of particles and acts as a buffer to spread out the particles along its length and deliver a smooth and constant flow of finely divided particles to column 11 regardless of the presence of minor fluctuations of flow from trough 26.

In a specific embodiment in which filament 16 is either a copper or aluminum electrical conductor and the electrostatic filament coater of the invention is being utilized to superimpose a continuous, concentric and flexible coat of insulation material thereon in the manufacture of magnet wire, each of the cones have the following dimensions,

| Cone | Diameter At Base |
|---|---|
| 12 | From about 4" to about 8" |
| 13 | From about 8" to about 12" |
| 14 | From about 8" to about 12" |
| 15 | From about 8" to about 12" |

Each of the cones are made from thin wall material having a constant wall thickness. The nozzle 30 would also have circular geometry in cross-sections taken transversely of the longitudinal axis thereof and would have the following dimensions:

Interior wall diameter adjacent 39 from about ½" to about 1"

Interior wall diameter at throat from about 2/16" to about 4/16"

Interior wall diameter adjacent orifice 37 from about ½" to about 1"

Diameter of electrode 46 from about 2" to about 4"

Diameter of electrode 47 from about 4" to about 6"

Diameter of electrode 48 from about 2" to about 4"

Diameter of electrode 49 from about 4" to about 6"

Diameter of electrode 50 from about 2" to about 4"

The density of the electrical field between the electrodes 46–50 and filament 26 is about 10,000 volts per inch. The amount of air being passed through the nozzle 30 is less than about 2.0 c.f.m. The exhaust 31 removes from about 3.0 to about 5.0 c.f.m. The particulate matter has a size ranging from about 12 microns to about 20 microns. The amount of particulate matter passing through nozzle from about 0.4 grams per second to about 0.6 grams per second. The filament 16 moves through the cones 12 through 15 at a speed in excess of 15 feet per minute.

Figure 2:
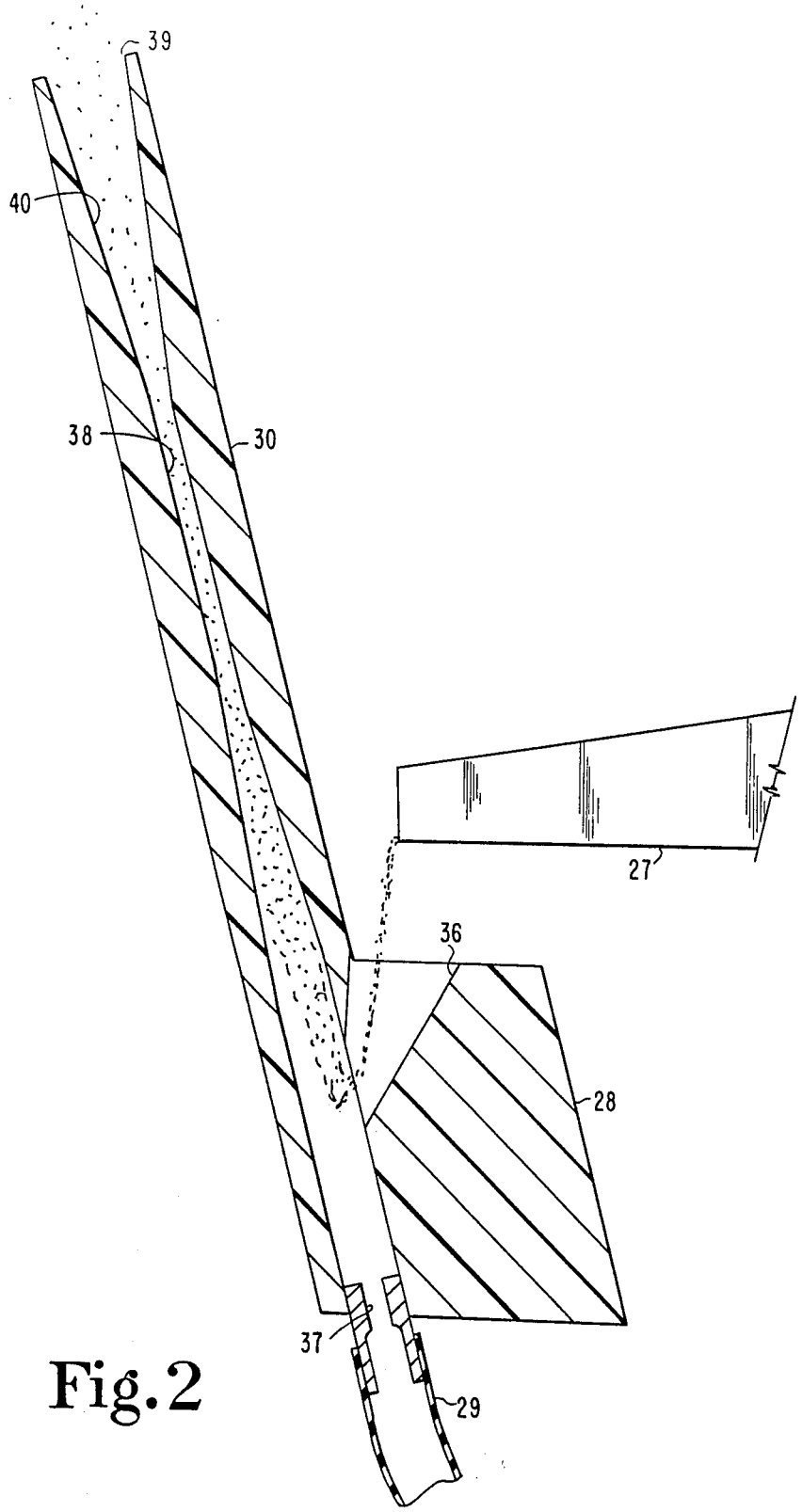
FIG. 2 is a cross-sectional elevational view of the powder injector nozzle of the filament coater of FIG.

Referring now to FIG. 2, the unagglomerated particles from the open end of trough 27 fall by gravity into opening 36 of particle injector 28, whereupon they are turned upward and accelerated by gas flow from orifice 37. The particulate then enters converging-constant section-diverging nozzle 30. Due to the presence of aerodynamic drag from the wall 38, as well as shock waves if sufficient pressure is used in orifice 37, a considerable variation in local velocity occurs across the flow during its movement through nozzle 30. The variation in local total pressure, or velocity pressure, is sufficient to break up remaining agglomerates of particles, plus further shear the particulates into generally finer form as they traverse nozzle 30. Powder exiting the nozzle at end 39 is decelerated from maximum speed due to the divergent geometry of passage 40.

Referring now to FIG. 3, material exiting the nozzle at 39 continues to decelerate in a free jet expansion, loosely confined by the geometry of the outer form of cone 45, and the inner geometry of cone 12. Deceleration from the high velocities necessary for the particle size reduction, to those where electrostatic forces can predominate, is required for good material deposition onto the target filament 16. Moving upwards while decelerating, the particulate enters a region of high corona discharge imposed by electrode 46, on which a near arc-over voltage is impressed by high voltage power supply 22. By conventional electrostatic means, the particulate becomes charged by bombardment and diffusion and is driven towards the target filment held at ground potential by grounded pulley 19. The convergent interior geometry of cone 12 also provides a net velocity vector of the airborne particulate towards the target filment 16. Such particulate that escapes charge in cone 12, passes upward into cone 13. Two high potential electrodes 47 and 48 are located within cone 13. Again, a convergent geometry of cone 13 provides a particulate velocity vector towards the filament 16, aiding in deposition due to increasing both the concentration of particulate and the horizontal velocity good deal of the filament 16 has become coated due to the preceding section 12 and the particulate is of a smaller average particle size than within the lower cones due to the gravitational effect on the particulate. Since the particulates are of a highly resistive nature, with long relaxation times, they continue to maintain their surface charge as the filament 16 moves upward. This not only provides means for the powder to remain affixed to the filament, but also provides a field opposing further deposition of powder on that spot. Thus, the powder forced toward the filament under the action of cone 13 is caused to seek out uncoated areas where no opposing charge exists, and the smaller uncoated areas are filled with the smaller particulate. Any number of stages can be added to the apparatus, in the manner of cones 14 and 15, with their electrodes 49 and 50. Material that is difficult to charge due to low resistivity may require more stages than that of high resistivity.

The upward flow of gas and particulates ejected from nozzle 30 tends to cause air to be drawn in through openings at the lower ends of the cones, such as at openings 51–54, which assists in the convergence of the particulate on the filament 16. However, this airflow is so slight as not to prevent oversprayed material from exiting the cones on the surfaces 55, 56, and 57. This material will accumulate there until it avalanches off, where it can be recovered and reused, if desired. This action on the outside of the cones is significant as it prevents sudden unwanted discharges of heavily concentrated particulates from entering the corona zones, thus potentially becoming charged and deposited onto filament 16, causing a momentary portion of increased material deposition inconsistent with the quality required of this process.

Referring once again to FIG. 1, the upward flow of air provided by particle injector 28 in most cases will provide enough upward draft within column 11 to enable the benefits associated with the unique geometry of column 11 to be realized. However, the upward draft can be enhanced if desired by applying suction to the top of column 11 via plenum 31. The exhaust from plenum 31 can be directed to conventional dust collection means for particulate emission control purposes and for recovery of undeposited particles for reuse, although it should be noted that when the transport rate of filament 16 and the flow rate of the particles into column 11 is properly adjusted, there is very little particle exhaust into plenum 31. In a specific embodiment, both the air and excess particulate may be recycled.

After emerging from the top of column 11, coated filament 21 passes through heating means 44 where the particulate coating can be heated to cause it to fuse into a smooth continuous and concentric coating. It has been found that infra-red heating is the most effective in causing even melting and flow of the particles.

Control module 35 provides control for vibrating troughs 26 and 27, heating means 34 and high voltage supply 22. While not shown, control module 35 could also be linked to the compressed air supply, the air suction supply of plenum 31, and the drive means for filament 16, Control module 35 is in essence a convenient collection of controls for enabling an operator to adjust each of the input variable switch affect the operation of wire coater 10. Deposition thickness control is affected by controlling the inputs of both wire and powder t the device, relying on the reasonably fixed deposition efficiency of the apparatus to maintain desired film thickness. If desired, the control could be automated with the emerging wire being monitored for dimensional or other characteristics and adjustments made automatically in response to such monitoring.

Decorative coatings can often be applied as thinner films, still maintaining required properties provided the coating apparatus has the inherent control and consistency of operation. This apparatus has both such features, and would serve to produce cost savings for much of the decorative market's coating needs.

Typical applications of this machine in the wire field might include magnet wire for electrical applications, structural cable, coated in either prewound strand form, or coated as a wound cable. Decorative wire used in such applications as furniture and coat hangers can also be coated.

End applications for articles such as magnet wire benefit from thinner insulative coatings. This is due to increasing the magnetic flux density because cores of transformers and coils can be bound more tightly.

But this invention is not limited to metallic wires. Filament including fiber optic cable can be coated with opaque coatings to improve their internal tranmission ability. Hot glass forms a suitably conductive filament.

Additionally, in the textile field, synthetics are often overcoated with natural fibers, for example, polyester is mercerized with cotton to provide comfort qualities desirable in clothing. Apparatus that exist now include electrostatic means for attracting the short cotton fibers to the polyester filament. These machines, as is known, run into problems with undeposited material accumulating in the coating chamber to some point and then falling into the electrostatic field and forming a heavy deposition on the filament, resulting in subsequent handling problems of the material. Inherent in the object of the present invention is a geometric arrangement which exhausts undeposited material outside of the coating region, and prevents it from reentering. Consequently, this machine could potentially have advantages over existing equipment known in the textile field.

Uses incidental to coating are also potential. For example, the apparatus could be used a precipitator for particulate. The wire could be put onto a closed loop form and recirculated through the apparatus, picking up particulate on each pass, then wiped clean upon its exit from the chamber. In this manner, for example, problems inherent in precipitator plate rapping could be eliminated.

Since it is possible to coat wire with diameters as large as ¼ inch diameter, a reciprocating rod of this size could be used in place of a recirculating wire in the precipitator if additional ruggedness of the collection element would prove necessary.

It is envisioned that the embodiment shown herein could be modified to coat conductive substrates other than a single wire, such as a plurality of parallel wires, or thin strips, or wide sheet material. Such modification might require cones with eliptical, rectangular, or other cross-sectional shapes to accommodate the geometry of the conductive substrate which is to be coated. Furthermore, additional particle injectors could be provided to insure even coating of all surfaces of strip and sheet substrates.

Although many uses for the present invention are envisioned, the preferred use as shown by the embodiment illustrated herein i the coating of copper wire with a synthetic resin. Good results have been achieved using a red epoxy powder, product number E31808-5N, sold by Morton Thiokol, Inc., P.O. Box 647, Warsaw, Ind. 46580.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. A method of coating a conductive filament comprising the steps of passing a filament through a cloud of particulate coating material suspended in gas, surrounding said filament with a plurality of spaced apart electrodes, said filament being trained to pass through each of said electrodes, thereby defining an annular space between said electrodes and said filaments, said cloud being trained to pass through said annular space in the direction of said filament, imposing a near arc-over potential to said electrodes, whereby said particulate coating material is electrostaticaly deposited on said filament, said filament being supported between a filament supply and a filament take-up, said take-up being spaced from said supply, said electrodes being supported on a plurality of coating chambers arranged coaxially of said filament in a spaced apart serial relation between said supply and said take-up, said coating chambers being of electrically non-conductive material, each of said coating chambers having a base and an apex and being generally frusto-conical in shape with an exit opening at said apex and an entrance opening at said base, said apex of said coating chambers remote from said take-up being positioned within the base of said next adjacent coating chamber, said cloud being introduced into said coating chamber most adjacent said filament supply and exhausted from said coating chamber most adjacent to said filament take-up.

2. The method of claim 1 wherein said gas of said cloud is recirculated.

3. The method of claim 2 wherein additional particulate material is added to said gas upon each recirculation.

4. The method of claim 1 wherein the excess particulate material is discharged away from said electrodes.

5. The method of claim 1 wherein the excess particulate material is discharged from between said coating chambers and the apex exit opening of said coating chamber most adjacent said take-up.

6. The method of claim 1 wherein said gas of said cloud is recirculated, and additional particulate material is added to said gas upon recirculation.

7. The method of claim 1 wherein the movement of said cloud through said coating chambers is less than about 20 foot per minute.

8. The method of claim 1 wherein said cloud contains from about 20 to about 40 grams of particulate material ranging in size from about 12 microns to about 20 microns in each cubic foot of gas.

9. The method of claim 1 wherein said near arc-over voltage results in a field between said electrodes and said filament of about 10,000 volts per inch.

10. The method of claim 1 wherein the movement of said filament through said coating chambers is greater than 15 feet per minute.

11. An electrostatic filament coater for a conductive filament comprising a filament supply and a filament take-up, said take-up being spaced from said supply, a plurality of coating chambers arranged coaxially in a spaced apart serial relation between said supply and take-up, said coating chambers being of electrically non-conductive material, each of said coating chambers having a base and an apex and being generally frusto-conical in shape with an exit opening at said and an entrance opening at said base, said apex of said coating chambers which are remote from said take-up being positioned within the base of said next adjacent coating chamber, said filament being trained through each of said coating chambers, said filament being coaxial with said coating chambers, a plurality of electrodes being positioned within said coating chambers, said electrodes surrounding and being coaxial of said filament, a near arc-over voltage being supplied to said electrodes, a fog of particular coating material suspended in gas being passed through said coating chambers in a direction of said filament movement from said supply to said take-up at a velocity which results in the electrostatic deposition of the particulate matter of said fog on said filament and the exhaust of the gas and excess particulate matter from between said coating chambers and the apex exit opening of said coating chamber most adjacent to said take-up.

12. The electrostatic coater of claim 11 wherein said coating chambers and said filament are geometrically similar in cross-section.

13. The electrostatic coater of claim 11 further comprising a gaseous exhaust connected to the apex of said coating chamber most adjacent to said take-up thereby assisting in the movement of said fog through said coating chambers.

14. The electrostatic coater of claim 11 further comprising an oven between said coating chamber most adjacent to said take-up, said filament being trained through said oven, whereby said filament and particulate coating material on said filament may be heated.

15. The electrostatic coater of claim 11 further comprising a reservoir of particulate coating material, a nozzle, and a compressed gas supply, said nozzle having an inlet and an outlet end and a converging-diverging throat portion therebetween, said nozzle outlet communicating with said coating chamber most remote from said take-up, said compressed gas supply communicating with said nozzle inlet, said reservoir communicating with said nozzle between said inlet and said converging-diverging portion of said nozzle, and a particulate coating material metering device positioned between and communicating with said nozzle and said reservoir.

16. The electrostatic coater of claim 11 wherein the movement of said cloud through said coating chambers is less than about 20 foot per minute.

17. The electrostatic coater of claim 11 wherein said cloud contains from about 20 to about 40 grams of particulate material ranging in size from about 12 microns to about 20 microns in each cubic foot of gas.

18. The electrostatic coater of claim 11 wherein said near arc-over voltage results in a field between said electrodes and said filament of about 10,000 volts per inch.

19. The electrostatic coater of claim 11 wherein the movement of said filament through said coating chambers is greater than 15 feet per minute.

* * * * *